US005585029A

United States Patent [19]

Kim et al.

[11] Patent Number: 5,585,029

[45] Date of Patent: Dec. 17, 1996

[54] HIGH LOAD-CARRYING TURBO OILS CONTAINING AMINE PHOSPHATE AND 2-ALKYLTHIO-1,3,4-THIADIAZOLE-5-ALKANOIC ACID

[75] Inventors: Jeenok T. Kim, Holmdel; Morton Beltzer, Westfield, both of N.J.

[73] Assignee: Exxon Research and Engineering Company, Florham Park, N.J.

[21] Appl. No.: 577,781

[22] Filed: Dec. 22, 1995

[51] Int. Cl.[6] ..... C10M 137/08

[52] U.S. Cl. ..... 508/274

[58] Field of Search ..... 252/32.5, 47.5

[56] References Cited

U.S. PATENT DOCUMENTS

| | | | |
|---|---|---|---|
| 2,836,564 | 5/1958 | Roberts et al. | 252/47.5 |
| 3,859,218 | 1/1975 | Jervis et al. | 252/32.5 |
| 4,130,494 | 12/1978 | Shaub et al. | 252/32.5 |
| 4,140,643 | 2/1979 | Davis | 252/47.5 |
| 4,193,882 | 3/1980 | Gemmill, Jr. | 252/47.5 |
| 4,226,732 | 10/1980 | Reinhard et al. | 252/47.5 |
| 4,701,273 | 10/1987 | Brady et al. | 252/32.5 |
| 5,055,584 | 10/1991 | Karol | 252/47.5 |
| 5,126,396 | 6/1992 | Orton et al. | 528/28 |
| 5,177,212 | 1/1993 | Karol et al. | 252/47.5 |
| 5,205,945 | 4/1993 | Cardis et al. | 252/47.5 |
| 5,279,751 | 1/1994 | Wu et al. | 252/46.6 |
| 5,462,682 | 10/1995 | Delfort et al. | 252/47.5 |

FOREIGN PATENT DOCUMENTS

| | | | |
|---|---|---|---|
| 0116460A2 | 8/1984 | European Pat. Off. | C10M 141/08 |
| 0310366 | 5/1989 | European Pat. Off. . | |
| 0434464 | 6/1991 | European Pat. Off. . | |

*Primary Examiner*—Margaret Medley
*Attorney, Agent, or Firm*—Joseph J. Allocca

[57] ABSTRACT

This invention relates to synthetic based turbo oils, preferably polyol ester-based turbo oils which exhibit exceptional load-carrying capacity by use of a synergistic combination of sulfur (S)-based and phosphorous (P)-based load additives. The S-containing additive of the present invention is 2-alkylthio-1,3,4-thiadiazole-5 alkanoic acid (ATAA) obtained by reacting 2,5-dimercapto-1,3,4-thiadiazole (DMTD) with alkyl bromide and subsequently reacting the intermediate with haloalkanoic acid. The P-containing additive is one or more amine phosphate(s). The turbo oil composition consisting of the dual P/S additives of the present invention achieves a superior load-carrying capacity over that obtained when each additive was used alone at individual treat rates higher than the total additive combination treatrate, and also meets or exceeds US Navy MIL-L-23699 requirements including Oxidation and Corrosion Stability and Si seal compatibility.

12 Claims, No Drawings

HIGH LOAD-CARRYING TURBO OILS CONTAINING AMINE PHOSPHATE AND 2-ALKYLTHIO-1,3,4-THIADIAZOLE-5-ALKANOIC ACID

BACKGROUND OF THE INVENTION

1. Field of the Invention

Load additives protect metal surfaces of gears and bearings against uncontrollable wear and welding as moving parts are heavily loaded or subjected to high temperatures. Incorporating high load-carrying capacity into a premium quality turbo oil without adversely impacting other properties can significantly increase the service life and reliability of the turbine engines.

The mechanism by which load additives function entails an initial molecular adsorption on metal surfaces followed by a chemical reaction with the metal to form a sacrificial barrier exhibiting reduced friction between the rubbing metal surfaces. In the viewpoint of this action, the effectiveness as load-carrying agent is determined by the surface activity imparted by a polar functionality of a load additive, and its chemical reactivity toward the metal; these features can lead to a severe corrosion if not controlled or prevented until extreme pressure conditions prevail. As a result, the most effective load additives carry deleterious side effects on other key turbo oil performances: e.g., corrosion, increased deposit forming tendency and elastomer incompatibility.

2. Description of the Prior Art

U.S. Pat. No. 4,140,643 discloses nitrogen- and sulfur-containing compositions that are prepared by reacting a 2,5-dimercapto-1,3,4-thiadiazole (DMTD) with oil-soluble dispersant and subsequently reacting the intermediate thus formed with carboxylic acid or anhydride containing up to 10 carbon atoms having at least one olefinic bond. The resulting compositions are claimed to be useful in lubricants as dispersant, load-carrying additive, corrosion inhibitor, and inhibitors of Cu corrosivity and lead paint deposition.

U.S. Pat. No. 5,055,584 discloses maleic derivative of DMTD to be used as antiwear and antioxidant in lubricating composition.

U.S. Pat. No. 4,193,882 is directed to improved corrosion inhibiting lube composition that contains the reaction product of DMTD with oleic acid.

Other references which teach the use of DMTD derivatives in lube composition to improve one or several of performance features (antiwear, extreme pressure, corrosion inhibition, antioxidancy) are EP 310 366-B1, U.S. Pat. No. 2,836,564, U.S. Pat. No. 5,126,396, U.S. Pat. No. 5,205,945, U.S. Pat. No. 5,177,212 and U.S. Pat. No. 5,279,751.

EP 434,464 is directed to lube composition or additive concentrate comprising metal-free antiwear and load-carrying additives containing sulfur and/or phosphorous, and an amino-succinate ester corrosion inhibitor. The antiwear and load additives include mono- or di-hydrocarbyl phosphate or phosphite with the alkyl radical containing up to $C_{12}$ or an amine salt of such a compound or a mixture of these; or mono- or dihydrocarbyl thiophosphate where the hydrocarbon (HC) radical is aryl, alkylaryl, arylalkyl, or alkyl or an amine salt thereof; or trihydrocarbyl dithiophosphate in which each HC radical is aromatic, alkylaromatic, or aliphatic; or amine salt of phosphorothioic acid; optionally with a dialkyl polysulfide and/or a sulfurized fatty acid ester.

U.S. Pat. No. 4,130,494 discloses a synthetic ester lubricant composition containing ammonium phosphate ester and ammonium organo-sulfonate, especially useful as aircraft turbine lubricants. The afore-mentioned lubricant composition have good extreme pressure properties and good compatibility with silicone elastomers.

U.S. Pat. No. 3,859,218 is directed to high pressure lube compositions comprising a major portion of synthetic ester and a minor portion of load-bearing additive. The load-carrying additive package contains a mixture of a quarternary ammonium salt of mono-($C_1$–$C_4$) alkyl dihydrogen phosphate and a quarternary ammonium salt of di-($C_1$–$C_4$) alkyl monohydrogen phosphate. In addition to the improved high pressure and wear resistance, the lubricant provides better corrosion resistance and causes less swelling of silicone rubbers than known oils containing amine salts of phosphoric and thiophosphoric acids.

DETAILED DESCRIPTION

A turbo oil having unexpectedly superior load-carrying capacity comprises a major portion of a synthetic base oil selected from diesters and polyol ester base oil, preferably polyol ester base oil and minor portion of a load additive package comprising a mixture of amine phosphate and 2-alkylthio-1,3,4-thiadiazole-5-alkanoic acid (ATAA) obtained by reacting 2,5-dimercapto-1,3,4-thiadiazole (DMTD) with alkyl halide (e.g., bromide) and reacting the subsequent intermediate with halo alkanoic acid.

The amine phosphate and the ATTA remain as distinctive species at normal formulation and storage conditions; however, it is speculated that under the extreme pressure conditions represented by high temperature (>300° C.), highly stressed metal surface, and deficient $O_2$, they may interact to promote the molecular breakdown to metal sulfide and phosphate, and to enhance their adsorption on the metal surface.

The diester that can be used for the high load-carrying turbo oil of the present invention is formed by esterification of linear or branched $C_6$–$C_{15}$ aliphatic alcohol with one of such dibasic acids as adipic, sebacic or azelaic acids. Examples of diesters are di-2-ethylhexyl sebacate and dioctyl adipate.

The preferred synthetic base stock which is synthetic polyol ester base oil is formed by the esterification of an aliphatic polyol with carboxylic acid. The aliphatic polyol contains from 4 to 15 carbon atoms and has from 2 to 8 esterifiable hydroxyl groups. Examples of polyol are trimethylolpropane, pentaerythritol, dipentaerythritol, neopentyl glycol, tripent aerythritol and mixtures thereof.

The carboxylic acid reactant used to produce the synthetic polyol ester base oil is selected from aliphatic monocarboxylic acid or a mixture of aliphatic monocarboxylic acid and aliphatic dicarboxylic acid. The carboxylic acid contains from 4 to 12 carbon atoms and includes the straight and branched chain aliphatic acids, and mixtures of monocarboxylic acids may be used.

The preferred polyol ester base oil is one prepared from technical pentaerythritol and a mixture of $C_4$–$C_{12}$ carboxylic acids. Technical pentaerythritol is a mixture which includes about 85 to 92% monopentaerythritol and 8 to 15% dipentaerythritol. A typical commercial technical pentaerythritol contains about 88% monopentaerythritol having the structural formula

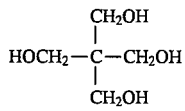

and about 12% of dipentaerythritol having the structural formula

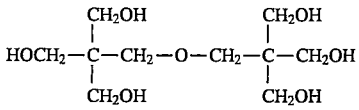

The technical pentaerythritol may also contain some tri and tetra pentaerythritol that is normally formed as by-products during the manufacture of technical pentaerythritol.

The preparation of esters from alcohols and carboxylic acids can be accomplished using conventional methods and techniques known and familiar to those skilled in the art. In general, technical pentaerythritol is heated with the desired carboxylic acid mixture optionally in the presence of a catalyst. Generally, a slight excess of acid is employed to force the reaction to completion. Water is removed during the reaction and any excess acid is then stripped from the reaction mixture. The esters of technical pentaerythritol may be used without further purification or may be further purified using conventional techniques such as distillation.

For the purposes of this specification and the following claims, the term "technical pentaerythritol ester" is understood as meaning the polyol ester base oil prepared from technical pentaerythritol and a mixture of $C_4$–$C_{12}$ carboxylic acids.

As previously stated, to the synthetic oil base stock is added a minor portion of an additive comprising a mixture of amine phosphate and ATAA.

The amine phosphate used includes commercially available monobasic hydrocarbyl amine salts of mixed mono- and di-acid phosphates and the amine salt of diacid phopshate. The mono- and di-acid phosphates have the structural formula:

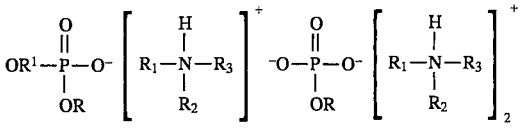

where

R and $R^1$ are the same or different and are $C_1$ to $C_{12}$ linear or branched chain alkyl $R_1$ and $R_2$ are H or $C_1$ to $C_{12}$ linear or branched chain alkyl $R_3$ is $C_4$ to $C_{12}$ linear or branched chain alkyl, or aryl-$R_4$ or $R_4$-aryl where $R_4$ is H or $C_1$–$C_{12}$ alkyl, and aryl is $C_6$.

The preferred amine phosphates are those wherein R and $R^1$ are $C_1$–$C_6$ alkyl, and $R_1$ and $R_2$ are H or $C_1$ to $C_4$ alkyl, and $R_3$ is aryl-$R_4$ where $R_4$ is linear chain $C_4$–$C_{12}$ alkyl, or $R_3$ is linear or branched chain $C_8$–$C_{12}$ alkyl.

The molar ratio of monoacid to diacid phosphate in the commercial amine phosphates used in this invention ranges from 3:1 to 1:3.

The mixed mono-/diacid phosphate and just the diacid phosphate can be used with the latter being the preferred.

The amine phosphates are used in an amount by weight in the range 50 to 300 ppm (based on base stock), preferably 75 to 250 ppm, most preferably 100 to 200 ppm amine phospate.

Materials of this type are available commercially from a number of sources including R. T. Vanderbilt (Vanlube series) and Ciba Geigy.

ATAA, the sulfur containing additive used in this invention, is made by a two step reaction. First, 2,5-dimercapto-1,3,4-thiadiazole (DMTD) is reacted with $C_1$–$C_{15}$ straight or branched chain alkyl halide, preferably alkyl bromide, in the presence of potassium hydroxide under ethanol reflux. The resultant 2-alkylthio-5-mercapto-1,3,4-thiadiazole (AMTD) is recovered as a solid by filtration and recrystallized in hexane. The recovered AMTD is then reacted with haloalkanoic acid, preferably bromoalkanoic acid by heating the mixture under ethanol reflux. The final product, ATAA, is extracted by diluting the reaction mixture with water followed by filtration, and is further purified by recrystallization using ethanol.

The final reaction product has the structural formula:

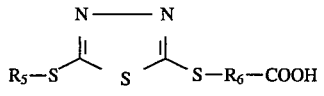

where:

$R_5$ is the linear or branched chain $C_1$ to $C_{15}$ alkyl while $R_6$ is the linear $C_1$ to $C_6$ alkyl.

The preferred ATAA are those wherein $R_5$ is $C_8$ to $C_{12}$ linear chain alkyl and $R_6$ is $C_1$ to $C_4$ alkyl.

The ATAA is used in an amount by weight in the range 100 to 1000 ppm (based on polyol ester base stock), preferably 150 to 800 ppm, most preferably 250 to 500 ppm.

The mixture of amine phosphate and ATAA is used in a total amount in the range 150 to 1300 ppm (based on polyol ester base stock), preferably 225 to 1050 ppm, most preferably 350 to 700 ppm.

The amine phosphate and the ATAA are used in the weight ratio of 1:1 to 1:10, preferably 1:1.5 to 1:5, most preferably 1:2 to 1:3 amine phosphate:ATAA.

The synthetic polyol ester-based high load-carrying oil may also contain one or more of the following classes of additives: antioxidants, antifoamants, antiwear agents, corrosion inhibitors, hydrolytic stabilizers, metal deactivator, detergents. Total amount of such other additives can be in the range 0.5 to 15 wt %, preferably 2 to 10 wt %, most preferably 3 to 8 wt %.

Antioxidants which can be used include aryl amines, e.g., phenylnaphthylamines and dialkyl diphenyl amines and mixtures thereof, hindered phenols, phenothiazines, and their derivatives.

The antioxidants are typically used in an amount in the range 1 to 5%.

Antiwear additives include hydrocarbyl phosphate esters, particularly trihydrocarbyl phosphate esters in which the hydrocarbyl radical is an aryl or alkaryl radical or mixture thereof. Particular antiwear additives include tricresyl phosphate, t-butyl phenyl phosphates, trixylenyl phosphate, and mixtures thereof.

The antiwear additives are typically used in an amount in the range 0.5 to 4 wt %, preferably 1 to 3 wt %.

Corrosion inhibitors include, but are not limited to, various triazols, e.g., tolyl triazol, 1,2,4-benzene triazol, 1,2,3-benzene triazol, carboxy benzotriazole, alkylated benzotriazol and organic diacids, e.g., sebacic acid.

The corrosion inhibitors can be used in an amount in the range 0.02 to 0.5 wt %, preferably 0.05% to 0.25 wt %.

Lubricating oil additives are described generally in "Lubricants and Related Products" by Dieter Klamann, Verlag Chemie, Deerfield, Fla., 1984, and also in "Lubricant Additives" by C. V. Smalheer and R. Kennedy Smith, 1967, pages 1–11, the disclosures of which are incorporated herein by reference.

The turbo oils of the present invention exhibit excellent load-carrying capacity as demonstrated by the severe FZG gear test, and meet or exceed the Oxidation and Corrosion Stability (OCS) and Si seal compatibility requirements set out by the United States Navy in MIL-L-23699 Specification. The FZG Failure Load Stage (FLS) 9 is achieved by polyol ester-based, fully formulated turbo oils to which have been added the load-carrying additive of the present invention consisting of a synergistic mixture of the amine phosphate and the ATAA. This represents a significant improvement in antiscuffing protection of heavily loaded gears from FLS 4 obtained by the same formulations without the amine phosphate and the ATAA, or from FLS 5 or 7/8 achieved with one of these two additives used alone at a weight percent greater than the total combination additive treat rate.

The present invention is further described by reference to the following non-limiting examples.

EXPERIMENTAL

In the following examples, a series of fully formulated aviation turbo oils were used to illustrate the performance benefits of using a mixture of the amine phosphate and ATAA in the load-carrying, OCS and Si seal tests. A polyol ester base stock prepared by reacting technical pentaerythritol with a mixture $C_5$ to $C_{10}$ acids was employed along with a standard additive package containing from 1.7–2.5% by weight aryl amine antioxidants, 0.5–2% tri-aryl phosphates, and 0.1% benzo or alkyl-benzotriazole. To this was added various load-carrying additive package which consisted of the following:

1) Amine phosphate alone: Vanlube 692, a mixed mono-/di-acid phosphate amine, sold commercially by R. T. Vanderbilt.

2) ATAA alone: this particular ATAA was prepared by reacting a DMTD with dodecyl bromide and subsequently reacting the thus formed intermediate with bromoacetic acid. Both reaction steps are carried out under ethanol reflux in the presence of potassium hydroxide. The final product is recovered as a solid by diluting the reaction mixture with water followed by filtration and is purified by recrystallization using ethanol.

3) Combination (present invention): the combination of the two materials described in (1) and (2).

These oils were evaluated in a more severe FZG gear test than the industry standard test to measure the ability of an oil to prevent scuffing of a set of moving gears as the load applied to the gears is increased. The "severe" FZG test mentioned here is distinguished from the FZG test standardized in DIN 51 354 for gear oils in that the test oil is heated to a higher temperature (140 versus 90° C.), and the maximum pitch line velocity of the gear is also higher (16.6 versus 8.3 m/s). The FZG performance is reported in terms of FLS, which is defined by a lowest load stage at which the sum of widths of all damaged areas exceeds one tooth width of the gear. Table 1 lists Hertz load and total work transmitted by the test gears at different load stages.

TABLE 1

| Load Stage | Hertz Load ($N/mm^2$) | Total Work (kWh) |
|---|---|---|
| 1 | 146 | 0.19 |
| 2 | 295 | 0.97 |
| 3 | 474 | 2.96 |
| 4 | 621 | 6.43 |
| 5 | 773 | 11.8 |
| 6 | 927 | 19.5 |
| 7 | 1080 | 29.9 |
| 8 | 1232 | 43.5 |
| 9 | 1386 | 60.8 |
| 10 | 1538 | 82.0 |

The OCS [FED-STD-791; Method 5308 @400° F.] and Si seal [FED-STD-791; Method 3433] tests used here to evaluate the turbo oils were run under the standard conditions as required by the Navy MIL-L-23699 specification.

The results from the severe FZG, Si seal and OCS tests are shown in Tables 2, 3 and 4, respectively. The wt % concentrations (based on the polyol ester base stock) of the amine phosphate and ATAA, either used alone or in combination are also specified in the tables.

TABLE 2

| Load Additives | Severe FZG FLS |
|---|---|
| None | 5 |
| 0.02 wt % Vanlube 692 (VL 692) | 5 |
| 0.10 wt % ATAA | 5 |
| 0.10 wt % VL 692 | 7 or 8 |
| 0.05 wt % ATAA + 0.02% VL 692 | 9 |

Table 2 demonstrates that the combination of the amine phosphate and the ATAA produces an improvement in the load-carrying capacity greater than that attained by each additive used alone at a treat rate higher than the total P/S combination treat rate. As signified by the more than double Hertz load exerted at load stage 9 as compared that at load stage 4 (see Table 1), the load-carrying advantage obtained by the amine phosphate/ATAA combination is substantial.

TABLE 3

| | MIL-23699-OCS TEST @ 400° F. | | | | |
|---|---|---|---|---|---|
| Load Additives | % Vis Change | Δ TAN mg KOH/g oil | Sludge (mg/100 cc) | Δ Cu ($mg/cm^2$) | Δ Ag ($mg/cm^2$) |
| None | 14.45 | 0.83 | 0.7 | −0.07 | −0.02 |
| 0.05% ATAA + 0.02% VL 692 | 8.94 | 0.22 | 2.3 | −0.08 | −0.05 |
| Limits | −5–25 | 3 | 50 | ±0.4 | ±0.2 |

The synergism of the present invention is for load carrying not for oxidation or corrosion stability. This test data is presented to show that there is no debit associated in using the mixture.

TABLE 4

| Load Additives | Δ Swell | % Tensile Strength Loss |
|---|---|---|
| Si Seal Compatibility (96 hour test at 250° F.) | | |
| None | 13.1 | 10.3 |
| 0.1% VL 692 | 3.9 | 84.4 |
| 0.02% VL 692 | 7.8 | 28.7 |
| 0.05% ATAA + 0.02% VL 692 | 8.1 | 22.7 |
| Spec | 5–25 | <30 |

Tables 3 and 4 show that the turbo oil containing the synergistic S/P load additive system also meets or exceeds the OCS and Si seal requirements whereas 0.1% VL 692 fails the Si seal test and achieves an inferior FZG load performance to that of the P/S combination used at the total additive treat rate of 0.07% (Table 2).

The present invention also teaches the importance of selecting the right "capping agent" to react with both mercaptans of a DMTD molecule. As shown in Table 5, there is a direct trade-off between the load activity and Cu corrosivity associated with DMTD and its derivatives. For instance, DMTD, per se, while highly effective as load-carrying agent, is very corrosive to Cu whereas the DMTD derivatives (1 and 2) other than the ones of the present invention, while benign to Cu, do not offer the load-carrying benefit and DMTD derivative (3) offer same load carrying benefit but does not meet Cu corrosion limit.

TABLE 5

| Load Additives | FZG FLS | OCS Δ Cu (mg/cm$^2$) |
|---|---|---|
| 0.05 wt % DMTD (underivatized) | 8 or 9 | −1.33 |
| 0.1 wt % DMTD Derivative(1) | 4 | −0.02 |
| 0.1 wt % DMTD Derivative(2) | 4 | −0.01 |
| 0.10 wt % DMTD Derivative(3) | 5 | <−0.58 |
| 0.05 wt % DMTD Derivative(3) + 0.02 wt % Vanlube 692 | 7 | −0.58 |
| 0.05 wt % ATAA + 0.02 wt % VL 692 | 9 | −0.08 |

(1)DMTD with both mercaptans capped with $C_{12}$ alkyl chains
(2)DMTD with both mercaptans capped with $C_3$ alkylaryl
(3)DMTD with both mercaptans capped with ester groups The criticality of the substituent to the DMTD molecule is also illustrated in Table 6. The DMTD derivative mentioned here is 2-(1-carboxyltridecanylthio)-1,3,4-thiadiazole-5-thione (CTDT) where the COOH group and long alkyl chain coexist at α-carbon to S. Unlike ATAA (see Table 3), CTDT caused an excessive sludge formation and unacceptably high oil viscosity increase and Cu loss.

TABLE 6

| Load Additives | Δ % Vis Change | Δ TAN mg KOH/g oil | Sludge (mg/100 cc) | Δ Cu (mg/cm$^2$) | Δ Ag (mg/cm$^2$) |
|---|---|---|---|---|---|
| OCS @ 400° F. | | | | | |
| 0.1% CTDT | 296.6 | 5.03 | 166.6 | −0.457 | −0.023 |
| Limits | −5–25 | 3 | 50 | ±0.4 | ±0.2 |

What is claimed is:

1. A turbo oil comprising a major amount of a base stock suitable for use as a turbo oil base stock and a minor amount of additives comprising a mixture of 2-alkylthio-1,3,4-thiadiazole-5-alkanoic acid, ATAA, and an amine phosphate.

2. The turbo oil of claim 1 wherein the base stock is a synthetic polyol ester.

3. The turbo oil of claim 1 wherein the 2-alkylthio-1,3,4-thiadiazole-5-alkanoic acid is represented by the structural formula

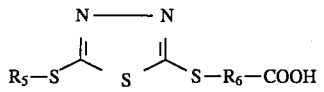

where $R_5$ is linear or branched $C_1$–$C_{15}$ alkyl and $R_6$ is linear $C_1$–$C_6$ alkyl.

4. The turbo oil of claim 3 wherein $R_5$ is $C_8$–$C_{12}$ linear alkyl and $R_6$ is $C_1$–$C_4$ alkyl.

5. The turbo oil of claim 1 wherein the amine phosphate and the ATAA are used in a weight ratio of 1:1 to 1:10.

6. The turbo oil of claim 1, 2, 3, 4 or 5 wherein the amine phosphate is monobasic hydrocarbyl amine salts of mixed mono and di acid phosphates.

7. The turbo oil of claim 1, 2, 3, 4 or 5 wherein the amine phosphate is monobasic hydrocarbyl amine salt of the diacid phosphate.

8. The turbo oil of claim 6 wherein the amine phosphate is of the structural formula

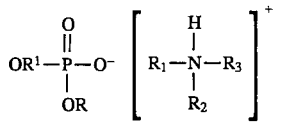

or

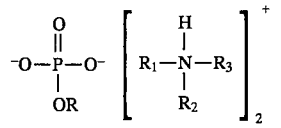

where

R and $R^1$ are the same or different and are $C_1$ to $C_{12}$ linear or branched chain alkyl;

$R_1$ and $R_2$ are H or $C_1$–$C_{12}$ linear or branched chain alkyl;

$R_3$ is $C_4$ to $C_{12}$ linear or branched chain alkyl or aryl -$R_4$ or $R_4$-aryl where $R_4$ is H or $C_1$–$C_{12}$ alkyl, and aryl is $C_6$.

9. The turbo oil of claim 8 wherein R and $R^1$ are $C_1$ to $C_6$ alkyl, and $R_1$ and $R_2$ are H or $C_1$ to $C_4$ alkyl, and $R_3$ is aryl-$R_4$ where $R_4$ is linear chain $C_4$–$C_{12}$ alkyl; or $R_3$ is linear or branched $C_8$–$C_{12}$ alkyl, and aryl is $C_6$.

10. The turbo oil of claim 1, 2, 3, 4 or 5 wherein the ATAA is present in an amount by weight in the range 100 to 1000 ppm and the amine phosphate is present in an amount in the range 50 to 300 ppm all based on base stock.

11. The turbo oil of claim 8 wherein the ATAA is present in an amount by weight in the range 100 to 1000 ppm and the amine phosphate is present in an amount in the range 50 to 300 ppm all based on base stock.

12. The turbo oil of claim 11 wherein the amine phosphate and the ATAA are used in a weight ratio of 1:1.5 to 1:5.

* * * * *